US006884322B2

(12) United States Patent
Bartelmuss et al.

(10) Patent No.: US 6,884,322 B2
(45) Date of Patent: Apr. 26, 2005

(54) INSTALLATION FOR PRODUCING A PAPER WEB

(76) Inventors: Klaus Bartelmuss, NR. 63, A-8833 Teufenbach (AT); Heinz Bartelmuss, NR. 63, A-8833 Teufenbach (AT)

( * ) Notice: Subject to any disclaimer, the term of this patent is extended or adjusted under 35 U.S.C. 154(b) by 33 days.

(21) Appl. No.: 10/405,848

(22) Filed: Apr. 2, 2003

(65) Prior Publication Data

US 2004/0011491 A1 Jan. 22, 2004

(30) Foreign Application Priority Data

Jul. 18, 2002 (AT) ..... A 1085/2002

(51) Int. Cl.[7] ..... D21F 1/00

(52) U.S. Cl. ..... 162/352; 162/351; 162/263; 162/374; 162/289; 162/199

(58) Field of Search ..... 162/352, 263, 162/252, 289, 351, 272, 374, DIG. 10, 199

(56) References Cited

U.S. PATENT DOCUMENTS 4,055,459 A * 10/1977 Best ..... 162/192
6,290,816 B1 * 9/2001 Graf ..... 162/253
6,444,094 B1 * 9/2002 Rulis et al. ..... 162/352

* cited by examiner

*Primary Examiner*—Mark Halpern
(74) *Attorney, Agent, or Firm*—Laurence A. Greenberg; Werner H. Stemer; Ralph E. Locher

(57) ABSTRACT

A system for making a paper web has at least one endless wire which is moved over load bearing and guide rolls. A pulp supply apparatus applies pulp to the wire. Suction devices and ceramic scrapers are arranged along the wire. There may also be present devices for the application, controlled by valves, of a coolant, in particular water, to the wire and the scrapers. At least some of the scrapers are constructed with at least one temperature sensor, whose output is connected to a display device or to a control unit.

8 Claims, 2 Drawing Sheets

INSTALLATION FOR PRODUCING A PAPER WEB

This application claims priority based on application 1085/2002 filed in Austria on 18 Jul. 2002.

BACKGROUND OF THE INVENTION

Field of the Invention

The present invention relates to a system for making a paper web, comprising at least one endless wire which is moved over load bearing and guide rolls, an apparatus for applying a pulp to the wire, suction devices arranged along the wire and ceramic wiper strips. Optionally, the system may include devices for the application, controlled by valves, of a coolant, in particular water, to the wire and the wiper strips.

Prior art systems of this type have at least one endless wire (screen) which is moved over load bearing and guide rolls or deflection rolls. A pulp or stock suspension, which contains about 1% solid constituents and about 99% water, is applied to the wire over its entire width by means of nozzles. The wire is guided at a speed of up to 2500 m/min over suction boxes and scrapers, i.e., wiper strips. As a result, the water contained in the pulp is drawn off.

Since, at the start of the production operation or in the event of production disruption, the wire moves over the foils without there being a pulp on the latter, the heat produced by the friction of the wire on the foils is not carried away. This effect occurs in particular in the regions of the suction boxes, in which the wire is pressed by the suction action against the foils located in the suction boxes. This applies in particular in those systems in which the pulp is between two wires since, because of the two wires, an increased suction action and therefore an increased contact force is effected. Likewise, as a result of the deflection of the wire over curved suction boxes, an additional compressive force that acts on the foils occurs, by means of which the friction occurring between the wire and the foils and the heat produced by this are increased sharply. Since the temperatures caused by this can reach several hundred degrees Celsius, this results in the risk of damage to the foils. As soon as the pulp is subsequently applied to the wire, the foils are cooled very abruptly, as a result of which the foils can likewise be damaged or destroyed.

In order to avoid these difficulties it has become known, in such a system, to provide spray nozzles by means of which water is applied to the wire and to the foils, by which means the required cooling of the foils is effected at the start of the production operation or during production disruption. However, this known measure therefore does not meet the requirements, since the cooling of the foils is performed without reference to the production conditions, for which reason it is possible for the case to occur in which, in the ceramic scrapers, a rise in temperature takes place as far as overheating of the same. For example, the suction action can be set wrongly, for which reason an excessively high friction between the wire and the foils is caused. Likewise, too little water can be extracted from the pulp, for which reason the required cooling is not effected, as a result of which impermissible heating of the foils likewise occurs. Then, as soon as the spray nozzles are switched on, there is additionally the risk of damaging or destroying the ceramic scrapers because of the very abrupt cooling of the same.

SUMMARY OF THE INVENTION

It is accordingly an object of the invention to provide a paper-web production installation, which overcomes the above-mentioned disadvantages of the heretofore-known devices and methods of this general type.

With the foregoing and other objects in view there is provided, in accordance with the invention, an installation for making a paper web, comprising:

a plurality of guide rolls and at least one endless wire to be moved over the guide rolls;

an apparatus for supplying pulp to the wire;

suction devices disposed alongside the wire, and a plurality of ceramic scrapers for scraping the wire. At least one scraper contains a temperature sensor with an output to be connected to a display device or to a control unit.

In other words, at least some of the scrapers or wiper strips are constructed with at least one temperature sensor, whose output is connected to a display device or to a control unit. The outputs from the control unit are preferably connected to the control valves of the devices for applying the coolant to the wire and the scrapers.

In accordance with an added feature of the invention, the coolant-supply system comprises a valve-controlled water feed system.

In accordance with an additional feature of the invention, the coolant-supply system includes a plurality of controlled valves and a plurality of outputs of the control unit are connected to the controlled valves for applying the coolant to the wire and the scrapers.

Outputs from the control unit are preferably connected to control values associated with the suction devices, or an output from the control unit is connected to the apparatus for discharging the pulp onto the wire. According to a preferred embodiment, the suction devices having at least one ceramic scraper are constructed with at least one temperature sensor, whose output is connected via the control unit to the control valve of the device associated with the relevant suction box for applying the coolant to the wire and the foils.

With the temperature sensors it is possible to measure and display the temperatures produced in the foils by the heat of friction and, as a result of which, on this basis, the required control, firstly of the devices for applying the coolant and secondly of the suction forces produced by the suction devices, can be effected and, furthermore, the discharging of the pulp onto the at least one wire can also be controlled.

Other features which are considered as characteristic for the invention are set forth in the appended claims.

Although the invention is illustrated and described herein as embodied in a system for making a paper web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
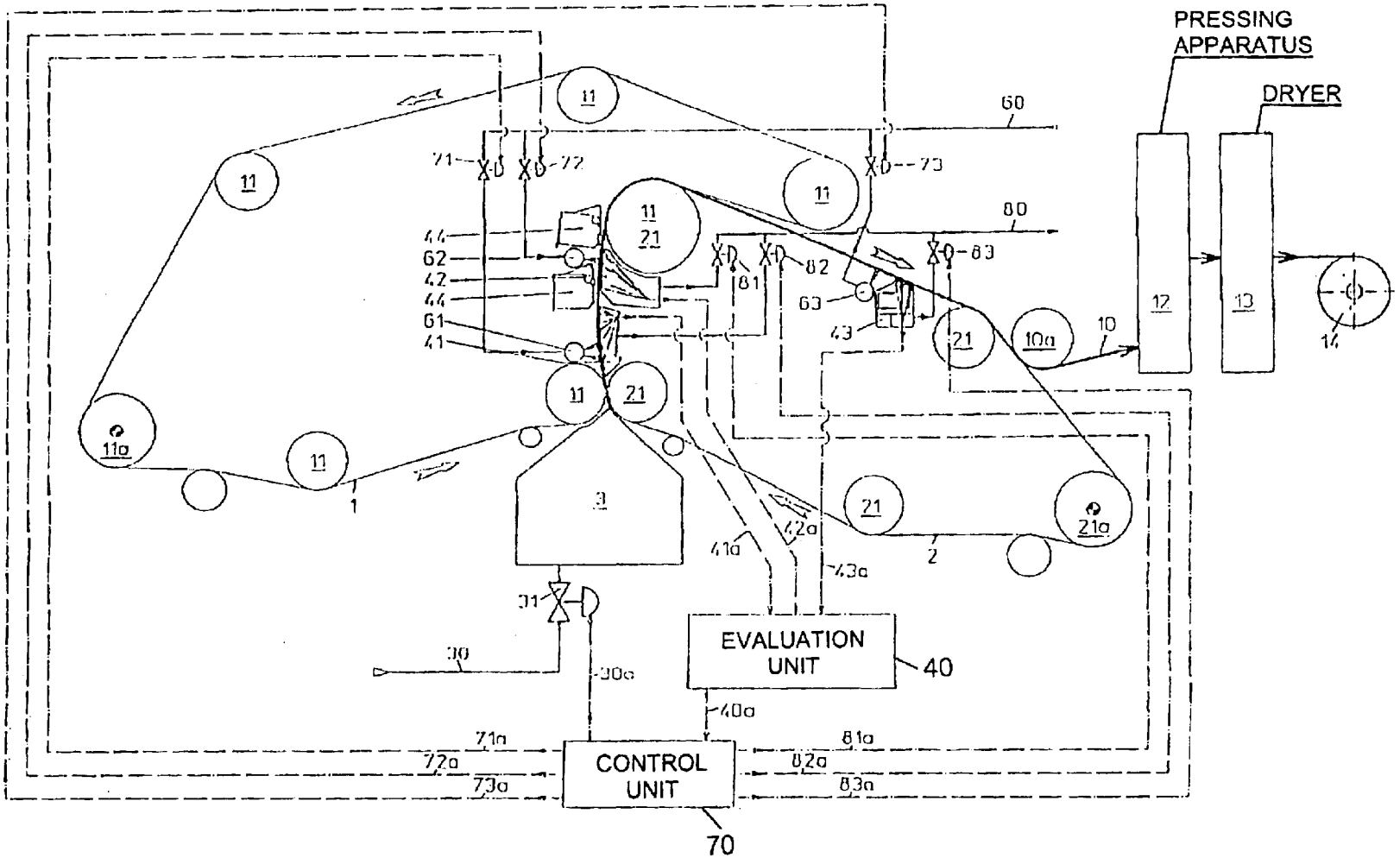
FIG. 1 is a schematic diagram of a system according to the invention.

Referring now to the figures of the drawing in detail and first, particularly, to FIG. 1 thereof, there is shown an installation for making a paper web 10. The system has two endless wires 1 and 2 (wire screens), which are guided over a plurality of load bearing and guide rolls 11 and 21. The rolls 11*a* and 21*a* are driven so that the wires 1 and 2 can be moved in circulation at a speed of up to 2500 m/min. The two first guide rolls 11 and 21 in the direction of movement, by means of which the two wires 1 and 2 are led together, are assigned an apparatus 3 for applying a pulp. The pulp, of which 1% consists of solids, in particular cellulose fibers, and 99% consists of water, is introduced between the two wires 1 and 2 over the entire width thereof.

In the direction of movement of the two wires 1 and 2, two suction boxes 41 and 42 and two groups of scrapers 44 are arranged. The suction boxes 41 and 42 are likewise constructed with scrapers. In addition, the suction boxes 41 and 42 are in each case assigned a spray nozzle 61 and 62, by means of which a coolant, in particular water, can be sprayed onto the wires 1 and 2 and onto the foils provided in the suction boxes 41 and 42. In the course of the movement of the wire 2, after a deflection roll 11, 21 which is common to both, the wire 2 is assigned a further spray nozzle 63, and the wire 2 runs over a further suction box 43 constructed with scrapers. The paper web 10 produced between the two wires 1 and 2 is lifted off the second wire 2 by means of a deflection roll 10*a*, is led over a pressing apparatus 12 and a drying apparatus 13 and wound up to form a reel 14.

As explained below with reference FIGS. 2 and 2A and also FIG. 3, the scrapers which are arranged in the suction boxes 41, 42 and 43 and which are produced from ceramic material are in each case constructed with at least one temperature sensor, by way of which the respective temperatures of the scapers can be measured. The outputs from these temperature sensors are connected via lines 41*a*, 42*a* and 43*a* to an evaluation unit 40. In the same way, the scrapers of the groups 44 can also be constructed with a temperature sensor in each case.

The output from the evaluation unit 40 is connected via a line 40*a* to a control unit 70. The outputs 71*a*, 72*a*, 73*a* from the control unit 70 are connected to control valves 71, 72 and 73, which are associated with the spray nozzles 61, 62 and 63, respectively, and which are located in a line 60 leading to the spray nozzles 61, 62 and 63 for a coolant, in particular water. Further outputs 81*a*, 82*a* and 83*a* from the control unit 70 are connected to control valves 81, 82 and 83, which are located in a vacuum line 80 leading to the suction boxes 41, 42 and 43.

A further output 30*a* from the control unit 70 is connected to a valve 31, which is located in a feed line 30 to the apparatus 3 for the application of the pulp.

Figure 2:
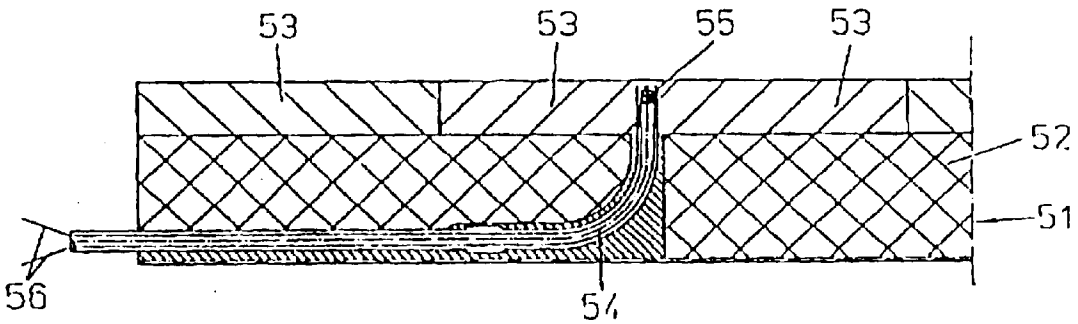
FIG. 2 is a partial longitudinal section of a ceramic scraper constructed with a temperature sensor.
Figure 2A:
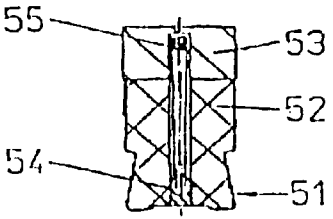
FIG. 2A is a transverse section of the ceramic scraper with the temperature sensor.

The scraper or foil 51 illustrated in FIGS. 2 and 2A comprises a load bearing plate 50, to whose upper side a plurality of ceramic plates 53 are fixed. The load bearing plate 52 is constructed with a recess, in which a temperature sensor 54 is arranged, whose sensor element 55 is located in one of the ceramic plates 53. The measured values determined by the sensor element 55 are output via a line 56.

The temperature sensors used are preferably thermocouples with the material pairing Fe—CuNi to DIN 43 710, Cl. 2 or NiCr—Ni to DIN EN 60 584, Cl. 2. Furthermore, platinum resistors to DIN IEC 751 can also be used.

Figure 3:
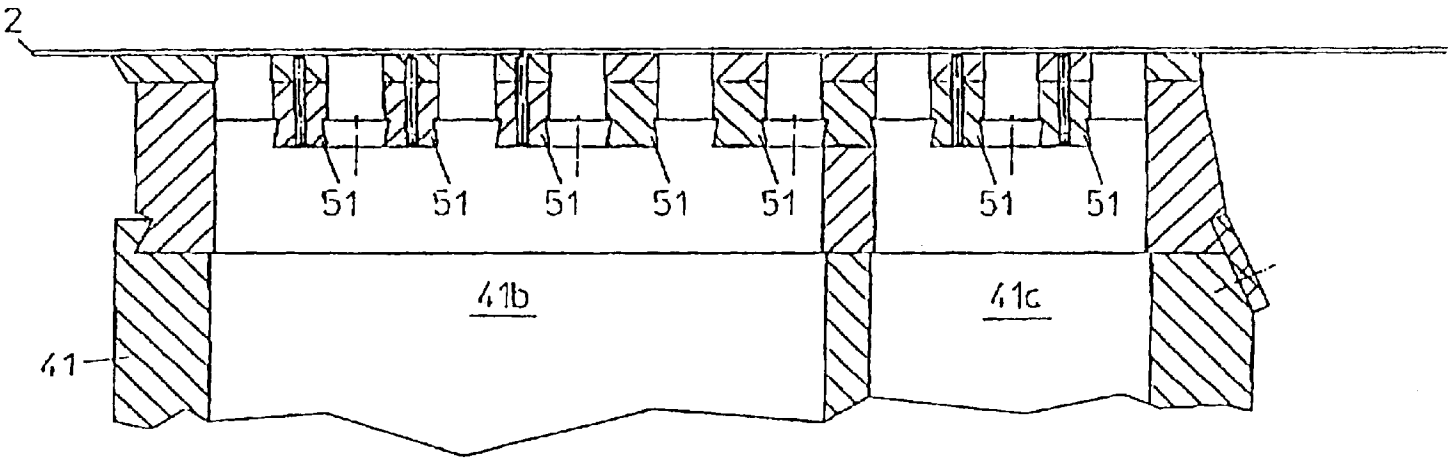
FIG. 3 is a sectional view of a suction box constructed with scrapers according to FIGS. 2 and 2A.

The suction box 41 is shown in FIG. 3. As this reveals, this suction box is subdivided into two vacuum regions 41*b* and 41*c* with different suction actions. A plurality of scrapers 51 constructed with temperature sensors are located in this suction box 41.

The installation operates as follows:

The pulp is introduced between the two wires 1 and 2 by way of the apparatus 3. By way of the suction boxes 41, 42 and 43, which are constructed with scrapers 51, and also by way of the groups 44 of scrapers, the water contained in the pulp is extracted from the latter. As a result, the paper web 10 is produced, which can subsequently be lifted off the wire and processed further.

Since this is known technology, we will not further elaborate.

By means of the temperature sensors 54 contained in the ceramic scrapers 51 of the suction boxes 41, 42 and 43, the temperatures occurring in the scrapers on account of the friction of the wires 1 and 2 with respect to the scrapers 51 are measured, and are evaluated in the evaluation unit 40. By means of the control signals output from the evaluation unit 40 to the control unit 70, it is possible firstly via the lines 71*a*, 72*a* and 73*a* to control the valves 71, 72 and 73 located in the water feed 60 to the spray nozzles 61, 62 and 63 and, secondly, to control the valves 81, 82 and 83 located in the vacuum line 80 leading to the suction boxes 41, 42 and 43. By way of the valves 71, 72 and 73, the application of the coolant, in particular water, to the wires 1 and 2 and the scrapers 51 is controlled. As a result, firstly overheating of the ceramic scrapers 51 and, secondly, damaging effects of thermal shock can be avoided. By means of controlling the suction actions produced by the suction boxes 41, 42 and 43, the friction occurring between the wires 1 and 2 and the scrapers 51 can be avoided, as a result of which the heat caused by this can likewise be controlled. These two measures can be carried out simultaneously or else alternatively.

In addition, the discharge of the pulp from the apparatus 3 between the wires 1 and 2 can be controlled by the control unit 70. This is advantageous since, in the event of overheating of the foils, a temperature shock can be caused by the pulp, which is prevented when no pulp is discharged.

This therefore provides a system by means of which monitoring and control of the temperatures occurring in the ceramic scrapers are carried out, as a result of which the damage to the ceramic scrapers caused by overheating and shock-like cooling of the same are avoided.

It is important in this case that at least some of the ceramic scrapers provided in the system are each constructed with at least one temperature sensor, by means of which the temperatures occurring in the foils are measured. These measured values can be led to a display device, it then being possible for manual control of the supply of coolant and/or the suction action of the suction boxes, and also control of the discharge of the pulp to be carried out. These measured values can, moreover, also be led to a control unit, by means of which program-controlled regulation of the supply of coolant and/or the suction action of the suction boxes and the discharge of the pulp can be carried out.

We claim:

1. An installation for making a paper web, comprising:

a plurality of guide rolls;

at least one endless wire to be moved over said guide rolls;

an apparatus for supplying pulp to said wire;

suction devices disposed alongside said wire;

ceramic scrapers including at least one scraper containing at least one temperature sensor with an output to be connected to a display device or to a control unit.

2. The installation according to claim 1, which further comprises a control unit connected to said output of said temperature sensor.

3. The installation according to claim 2, wherein said suction devices include control valves connected to respective outputs of said control unit.

4. The installation according to claim 2, wherein said control unit has an output connected to said apparatus for supplying the pulp onto the wire.

5. The installation according to claim 2, wherein said suction devices contain said at least one ceramic scraper constructed with at least one temperature sensor, said temperature sensor includes an output connected via said control unit to a respective control valve of a coolant-supply device associated with the relevant suction box for applying the coolant to said wire and said scrapers.

6. The installation according to claim 1, which further comprises a coolant-supply system for applying a coolant to said wire and to said scrapers.

7. The installation according to claim 6, wherein said coolant-supply system comprises a valve-controlled water feed system.

8. The installation according to claim 7, wherein said coolant-supply system includes a plurality of controlled valves and a plurality of outputs of the control unit are connected to said controlled valves for applying the coolant to said wire and said scrapers.

* * * * *